US010130981B2

(12) United States Patent
Cramer

(10) Patent No.: US 10,130,981 B2
(45) Date of Patent: Nov. 20, 2018

(54) METHOD AND DEVICE FOR DESCALING A METALLIC SURFACE AND INSTALLATION FOR PRODUCING SEMIFINISHED METALLIC PRODUCTS

(71) Applicant: SMS GROUP GMBH, Düsseldorf (DE)

(72) Inventor: Markus Cramer, Attendorn (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 15/100,421

(22) PCT Filed: Nov. 28, 2014

(86) PCT No.: PCT/EP2014/076023
§ 371 (c)(1),
(2) Date: May 31, 2016

(87) PCT Pub. No.: WO2015/079052
PCT Pub. Date: Jun. 4, 2015

(65) Prior Publication Data

US 2016/0303627 A1 Oct. 20, 2016

(30) Foreign Application Priority Data

Nov. 29, 2013 (DE) ..... 10 2013 224 506

(51) Int. Cl.
*B21B 45/08* (2006.01)
*B21B 45/06* (2006.01)

(52) U.S. Cl.
CPC ..... *B21B 45/08* (2013.01); *B21B 45/06* (2013.01)

(58) Field of Classification Search
CPC ..... B21B 45/04; B21B 45/06; B21B 45/08; Y10T 29/4544
See application file for complete search history.

(56) References Cited

U.S. PATENT DOCUMENTS 5,502,881 A * 4/1996 Gaydoul ..... B05B 3/02 134/122 R
5,697,241 A 12/1997 Djumlija et al.
(Continued)

FOREIGN PATENT DOCUMENTS

DE 4328303 A1 6/1994
DE 4302331 A1 * 8/1994 ..... B08B 3/022
(Continued)

OTHER PUBLICATIONS

Machine translation of DE 4302331 A1, Gaydoul et al. pp. 1-5, translated on Apr. 28, 2017.*
(Continued)

*Primary Examiner* — Teresa M Ekiert
(74) *Attorney, Agent, or Firm* — Lucas & Mercanti, LLP; Klaus P. Stoffel

(57) ABSTRACT

A method for descaling a metal surface of a semifinished metal product, including the steps of: guiding the semifinished metal product in a transporting direction past nozzle head parts that rotate about rotation axes and are arranged alongside one another transversely to the transporting direction; and directing high-pressure fluid jets produced by nozzle elements arranged on the rotating nozzle head parts at the metal surface. The fluid jets also being blasted as far as the metal surface at a narrow point between two immediately adjacent nozzle head parts. The nozzle head parts rotate synchronously with one another at a preset angular position with respect to a rotation angle of a particular rotation axis of the nozzle head parts. The fluid jets produced by the nozzle elements are always blasted onto the metal surface past one another without coming into contact with one another.

13 Claims, 2 Drawing Sheets

(56) References Cited

U.S. PATENT DOCUMENTS

| | | | |
|---|---|---|---|
| 7,958,609 | B2 | 6/2011 | Gaydoul |
| 2007/0027735 | A1 | 2/2007 | Rokos |

FOREIGN PATENT DOCUMENTS

| | | | |
|---|---|---|---|
| JP | 06-226215 | | 8/1994 |
| JP | H06226215 | A | 8/1994 |
| JP | H11216513 | A | 8/1999 |
| JP | 11-216513 | | 10/1999 |
| WO | 2005082555 | A1 | 9/2005 |

OTHER PUBLICATIONS

The Patent Office of the People's Republic of China, First Office Action, dated Apr. 12, 2017.

* cited by examiner

METHOD AND DEVICE FOR DESCALING A METALLIC SURFACE AND INSTALLATION FOR PRODUCING SEMIFINISHED METALLIC PRODUCTS

The present application is a 371 of International application PCT/EP2014/076023 filed Nov. 28, 2014, which claims priority of DE 10 2013 224 506,8, filed Nov. 29, 2013, the priority of these applications is hereby claimed and these applications are incorporated herein by reference.

BACKGROUND OF THE INVENTION

The invention relates to a method for descaling a metal surface of a semifinished metal product, in which the semifinished metal product is guided in the transporting direction past nozzle head parts that rotate about rotation axes and are arranged alongside one another transversely to this transporting direction, and in which high-pressure fluid jets that are directed at the metal surface are produced by means of nozzle elements arranged on these rotating nozzle head parts, said fluid jets also being blasted as far as the metal surface at a narrow point between two immediately adjacent nozzle head parts.

The invention also relates to an apparatus for carrying out a method for descaling a metal surface of a semifinished metal product, having a nozzle device, past which the semifinished metal product is guidable in the transporting direction, wherein the nozzle device has a multiplicity of nozzle head parts that rotate about the rotation axes, said nozzle head parts having nozzle elements for producing high-pressure fluid jets that are directed at the metal surface, wherein the nozzle head parts are arranged alongside one another such that the fluid jets produced by the nozzle elements are also blasted as far as the metal surface at a narrow point between two immediately adjacent nozzle head parts.

Furthermore, the invention relates to an installation for producing semifinished metal products, in particular metal strip material, having an apparatus for descaling the metal surfaces of the semifinished metal products.

In particular generic methods and apparatuses are well known from the prior art.

For example, the laid-open specification DE 43 28 303 A1 discloses a device for descaling hot rolled materials which are guided past this device. In that case, the surfaces of each rolled material are then cleaned or descaled by being blasted on both sides with high-pressure water. The descaling device proposed therein has nozzle heads arranged in a row alongside one another, which are each driven in rotation about a rotation axis by a motor. The nozzle heads have at least one eccentrically arranged nozzle, by means of which high-pressure water jets are produced and can be blasted onto the surfaces. By way of the rotationally driven nozzle heads, an improved surface quality of the blasted surfaces of the rolled material is intended to be achieved.

The international application WO 2005/082 555 A1 discloses a further device for descaling hot rolled materials, having nozzle heads arranged in a row, which are each driven in rotation about a rotation axis by a motor. The descaling device taught therein is characterized in that the nozzles arranged on the rotationally driven nozzle heads are arranged as close as structurally possible to the circumference of the particular nozzle head. In that case, a spray pattern is intended to be produced on the rolled material surface, said spray pattern at least touching the spray pattern of the adjacent nozzle head in the nozzle head row in order to achieve uniform descaling of the rolled material surface over the width thereof. Furthermore, adjacent nozzle heads in the nozzle head row are intended to rotate in opposite directions in order to avoid undesired mutual jet influencing.

Furthermore, U.S. Pat. No. 5,697,241 A describes a rolling device having a rolling stand and an upstream rotor descaling device, wherein the liquid jets emerging from the rotor descaling device and striking the rolled material are directed counter to the rolling direction. As a result, the liquid striking the rolled material surface at the striking point of the liquid jet is intended, after striking, to have a flow resultant which has a component in the opposite direction to the rolling direction such that, in spite of as little liquid application as possible, a satisfactory surface quality is achievable.

A further descaling device for descaling a semifinished metal product is disclosed in JP H11 216513 A, in which rotary heads equipped with high-pressure water nozzles are arranged not only alongside one another in the widthwise direction of the semifinished metal product but also in an offset manner with respect to one another in the conveying direction of the semifinished metal product, in order to achieve operationally reliable descaling across the entire width of the semifinished metal product. However, this descaling device has a very deep construction in the conveying direction.

JP H06 226215 A discloses a further cleaning machine having rotating nozzle heads that is movable over a surface to be cleaned, for instance a floor or the like, said rotating nozzle heads each comprising a rotor arm, wherein each of the rotor arms has two or more high-pressure nozzles, the liquid jets of which merge at a point before the surface to be cleaned, in order to achieve an improved cleaning effect. The rotor arms are arranged with respect to one another and operated such that, although they mesh with one another during rotation, they do not collide with one another.

SUMMARY OF THE INVENTION

The invention is based on the object of improving the cleaning effects of generic descaling apparatuses with regard to descaling of metal surfaces of corresponding semifinished metal products.

The object of the invention is achieved by a method for descaling a metal surface of a semifinished metal product, in which the semifinished metal product is guided in the transporting direction past nozzle head parts that rotate about rotation axes and are arranged alongside one another transversely to this transporting direction, and in which high-pressure fluid jets that are directed at the metal surface are produced by means of nozzle elements arranged on these rotating nozzle head parts, said fluid jets also being blasted as far as the metal surface at a narrow point between two immediately adjacent nozzle head parts, wherein the method is characterized in that the nozzle head parts rotate synchronously with one another at such a preset angular position with respect to a rotation angle of the particular rotation axis of the nozzle head parts that the fluid jets produced by means of the nozzle elements are always blasted onto the metal surface past one another without coming into contact with one another.

Within the meaning of the invention, "synchronously" means that angular positions that have been set in a corresponding manner between the nozzle head parts do not change unintentionally with respect to one another while the nozzle head parts rotate.

The risk of in particular two nozzle elements of two immediately adjoining nozzle head parts being positioned simultaneously at the narrow point in any operating phase can be completely ruled out in that the nozzle head parts are set, in terms of their angular positions, such that the fluid jets produced by means of the nozzle elements are always, that is to say at least in each descaling phase, blasted onto the metal surface past one another without coming into contact with one another.

As a result of the nozzle head parts being additionally rotated in this case in a manner synchronized with one another, the nozzle head parts are prevented from shifting with respect to one another in terms of their angular positions such that this is no longer ensured in every essential operating phase.

Therefore, it is advantageous for the nozzle head parts of the nozzle device to rotate in a manner synchronized with one another at set angular positions in which the fluid jets of two closest nozzle elements in particular of two immediately adjacent nozzle head parts can be blasted onto the metal surface past one another without coming into contact with one another.

Advantageously, the rotational movements of the individual nozzle head parts, or of their drive means, are to this end synchronized in a correct position such that the individual nozzle head parts always revolve as required in a manner oriented with respect to one another.

As a result of the method according to the invention, a situation is thus avoided in which, for instance during corresponding rotor descaling, individual fluid jets have a negative influence on one another before striking the metal surface and as a result weaken one another or even cancel one another out entirely, as has hitherto been able to be the case in the prior art. Such effects occur especially at narrow points between two immediately adjacent nozzle head parts when nozzle elements are guided simultaneously past this narrow point.

Such simultaneous guidance of nozzle elements past the narrow point of two nozzle head parts arranged directly alongside one another has hitherto often unintentionally occurred because setting technology and/or control or regulating technology has not hitherto ensured that the individual nozzle head parts always alternately pass the narrow point. Rather, the rotary head parts arranged alongside one another somehow rotate with respect to one another.

The term "always" describes in this case any operating phase of the rotatable or rotating nozzle head parts at least during a descaling process.

In the present case, however, the individual nozzle head parts rotate synchronously and in a correct position with respect to one another, thereby avoiding a situation in which nozzle elements of directly adjacent nozzle head parts are guided simultaneously past the narrow point.

To this extent, the cleaning effect on metal surfaces is improved substantially in the present case.

In this case, it is then unimportant whether two directly adjacent nozzle head elements rotate in the same direction as or in opposite directions to one another, since the nozzle elements are always oriented with respect to one another, in terms of their angular positions, such that the fluid jets of two closest nozzle elements of two immediately adjacent nozzle head parts are blasted onto the metal surface past one another without coming into contact with one another.

In the present case, a very wide variety of media can be used as fluid jets, as long as they are suitable for descaling the metal surface or cleaning it in some other way. Preferably, high-pressure water jets are used as fluid jets in the present case. The fluid jets can be produced as a conical jet geometry, elliptical jet geometry, flat jet geometry or the like.

The metal surface is for example a hot-rolled surface which is intended to be freed of a layer of scale. It goes without saying that, by means of the present invention, other undesired substances adhering to the metal surface can also be removed therefrom.

The semifinished metal product is, within the meaning of the invention, for instance forged or rolled metal strip material, for example slabs, thin slabs, hot strip, precursor strip or the like.

The nozzle head parts, arranged in a row alongside one another, of the nozzle device are in the present case each mounted so as to be rotatable about a separate rotation axis. This rotation axis extends preferably perpendicularly to the semifinished metal product conveyed in the transporting direction.

Arranged at each of the nozzle head parts is at least one nozzle element which has at least one outlet opening from which a high-pressure liquid jet emerges. In the simplest case, such an outlet opening can represent the nozzle element within the meaning of the invention.

The term "narrow point" describes, within the meaning of the invention, a region with a smallest distance between two directly opposite nozzle head parts, at which nozzle elements of the two nozzle head parts are located opposite one another, i.e. are closest together, when these two nozzle head parts rotate correspondingly about their particular rotation axis. This narrow point is located on a connecting line connecting all of the rotation axes. The narrow point thus describes a region in which two nozzle head parts are arranged so close together that the fluid jets produced by two nozzle elements that are temporarily rotated into said region can overlap or at least touch before striking the metal surface, with the result that they disadvantageously impede one another.

Preset angular positions can be maintained in an operationally reliable manner when the nozzle head parts rotate at rotational speeds that are synchronized with one another.

If the nozzle head parts are accelerated in a synchronized manner, exact compliance with preset angular positions with regard to the nozzle head parts can be additionally improved. This goes both for positive and for negative acceleration.

In order to be able to always ensure desired or required angular positions with regard to the individual nozzle head parts with respect to one another, it is advantageous for the respective angular positions of the nozzle head parts to be calibrated with one another, for example before a treatment of a metal surface with the present apparatus or during ongoing operation.

During such calibration, in particular the angular positions and the rotational speeds of the individual nozzle head parts are set with respect to one another such that the nozzle elements of the immediately adjacent nozzle head parts always pass the narrow point alternately such that the fluid jets produced by means of the nozzle elements are always blasted onto the metal surface past one another without coming into contact with one another.

To this extent, an advantageous method variant also provides for the nozzle elements of two immediately adjacent nozzle head parts to always pass the narrow point alternately such that the fluid jets produced by means of the nozzle elements are always blasted onto the metal surface past one another without coming into contact with one another.

In this connection, it is advantageous for the nozzle elements of two immediately adjacent nozzle head parts to always be guided past the narrow point with a time lag. As a result, disadvantageous influencing of two fluid jets can be prevented in a further improved manner within the meaning of the invention.

It goes without saying that the time lag has to be selected to be sufficiently large for the desired effects to be achieved.

The object of the invention is furthermore also achieved by an apparatus for carrying out a method for descaling a metal surface of a semifinished metal product, this is characterized in that the nozzle head parts are connected together in a mechanically and/or electronically interacting manner such that the individual nozzle head parts of the nozzle device are always arranged in a manner oriented at preset angular positions with respect to one another.

In principle, in the case of an electronic coupling, it is particularly easily possible to select different basic positions with regard to the angular positions of the rotating nozzle head parts with respect to one another at the start of a production process of the semifinished metal product or of a descaling process of metal surfaces, in order to achieve the in each case most favorable cleaning result depending on parameters, for instance a distance of the nozzle elements from the metal surface of the semifinished metal product or a transporting speed of the semifinished metal product relative to the nozzle elements.

Since the individual rotating nozzle head parts are always arranged, with regard to their angular positions, in a manner oriented with respect to one another such that the fluid jets produced by means of the nozzle elements are always able to be blasted onto the metal surface past one another without coming into contact with one another, the cleaning effect with regard to metal surfaces is substantially increased.

This is ensured in the present case in that the precise angular positions of the individual nozzle head parts are firmly defined. Thus, the individual rotating nozzle head parts maintain their defined angular position with respect to one another.

With the present apparatus, in particular the present method can be carried out in an advantageous manner.

One variant embodiment provides for the nozzle elements of two immediately adjacent nozzle head parts to always be arranged, in terms of their angular positions, in a manner oriented with respect to one another such that the fluid jets produced by means of the nozzle elements are always able to be blasted onto the metal surface past one another without coming into contact with one another.

Preferably, the individual angular positions of the nozzle head parts are oriented in a manner rotated through a rotation angle offset with respect to one another such that the nozzle elements of two immediately adjacent nozzle head parts always enter the region of the narrow point with a time lag, and so only one nozzle element and thus also only one fluid jet is ever temporarily positioned at the narrow point.

A particularly preferred variant embodiment provides for the apparatus to have a drive device for driving the nozzle head parts, by means of which the nozzle head parts are drivable in a synchronized manner in terms of their rotational properties.

The term "rotational properties" means specifically the angular acceleration and the angular speed of the individual nozzle head parts.

It goes without saying that the drive device can be constructed differently. For example, each of the nozzle head parts can be assigned a separate drive motor as drive means. Alternatively, the drive device comprises only one drive motor as drive means, which is operatively connected to the nozzle head parts via a corresponding transmission unit.

Negative influencing of two fluid jets in the region of the narrow point between two nozzle head parts can always be ruled out when the nozzle elements of two immediately adjacent nozzle head parts are arranged, in terms of their angular positions, in a manner offset by more than 5° or by more than 15°, preferably by 45°, with respect to one another.

The object of the invention is also achieved by an installation for producing semifinished metal products, in particular metal strip material, having an apparatus for descaling the metal surfaces of the semifinished metal product, wherein the installation is characterized by an apparatus for descaling according to one of the features described here. By means of an installation equipped in such a way, corresponding semifinished metal products can be produced with particularly high surface quality.

Further features, effects and advantages of the present invention are explained with reference to the appended drawing and the following description, in which an installation for producing semifinished metal products having a descaling apparatus is described and illustrated by way of example, wherein individual rotating nozzle head parts are always arranged, with regard to their angular positions, in an oriented manner with respect to one another such that the fluid jets produced by nozzle elements are able to be blasted onto the metal surface past one another without coming into contact with one another.

DETAILED DESCRIPTION OF THE INVENTION

Figure 1:
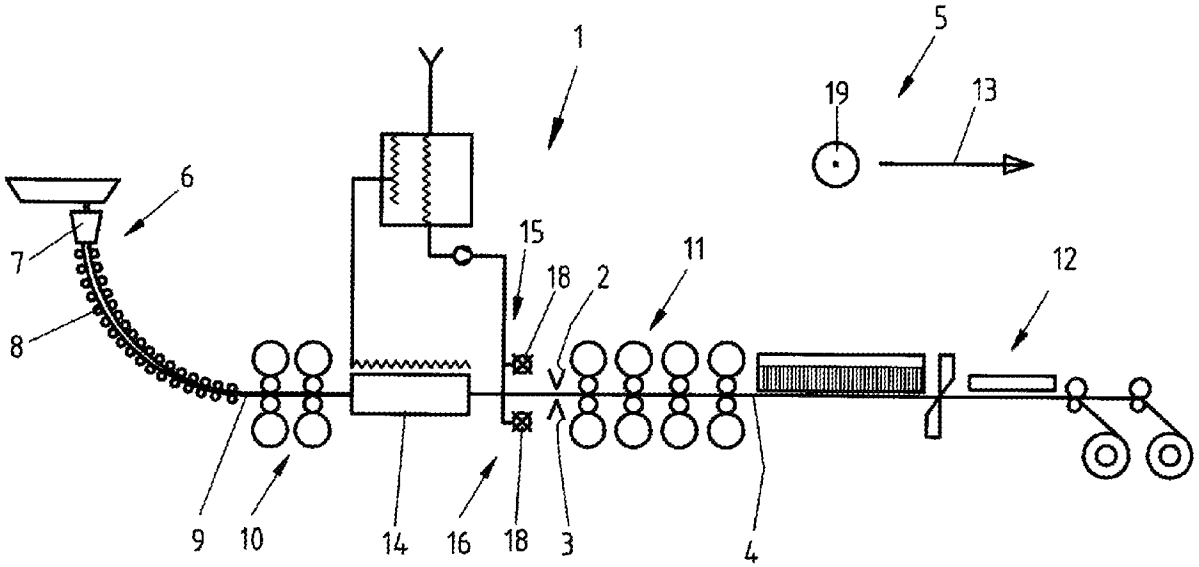
FIG. 1 schematically shows an installation for producing a semifinished metal product.

The present inventive apparatus 1 for descaling metal surfaces 2 and 3 of a semifinished metal product 4 is integrated, according to the exemplary embodiment shown in FIG. 1, into an installation 5 for producing the semifinished metal product 4. The installation 5 in this case comprises a casting machine 6 having a mold 7 and a casting bow 8, wherein the semifinished metal product 4 emerging from the casting bow 8 and in the form of a metal strip 9 is subsequently conveyed in the transporting direction 13 through various roughing stands 10 and stands 11 of a production line 12. Also provided is an induction furnace 14 by means of which the metal strip 9 is raised to a higher temperature following a rolling operation in the roughing stands 10. The descaling of the surfaces 2 and 3 takes place downstream of the induction furnace 14 by way of the apparatus 1 for descaling, wherein the apparatus 1 comprises a descaling device 15.

The apparatus 1 is characterized in particular by a nozzle device 16 which consists, both above the metal strip 9 and below the metal strip 9, in each case of an arrangement of seven nozzle head parts 18 arranged alongside one another in a row 17 (cf. also FIG. 2). The row 17 extends in this case in the widthwise direction 19 of the metal strip 9 transversely to the transporting direction 13.

Each of the nozzle head parts 18 that are present is mounted in the nozzle device 16 such that it rotates about a separate rotation axis 20 (only designated by way of example). Furthermore, each of the nozzle head parts 18 has four nozzle elements 22, 23, 24 and 25 that are arranged in a manner offset through 90° with respect to one another around the outer periphery 21 of the nozzle head parts 18.

The nozzle elements 22 to 25 have at least one outlet opening (not shown) from which a high-pressure fluid jet (not shown here) can emerge, wherein the nozzle elements 22 to 25 are arranged such that the fluid jets produced thereby are blasted onto the particular surface 2 or 3. All of the nozzle elements 22 to 25 rotate in this case in the same direction, in the direction of rotation 26, about their particular rotation axis 20. The rotation axes 20 are in this case located on a common fictitious connecting line 27.

In order to prevent individual fluid jets from crossing or touching one another such that their jet actions reduce one another or cancel one another out, the nozzle head parts 18 are arranged alongside one another such that the fluid jets produced by the nozzle elements 22, 23, 24 and 25 are always able to be blasted onto the metal surface 2, 3 past one another without coming into contact with one another at a particular narrow point 30 between two immediately adjacent nozzle head parts 18.

To this end, the individual rotating nozzle head parts 18 are arranged, with regard to their particular angular position 31 or 32 (only designated by way of example here), in a manner oriented with respect to one another such that the nozzle elements 22, 23, 24, 25 of two immediately adjacent nozzle head parts 18 always pass alternately through the particular narrow point 30.

Figure 2:
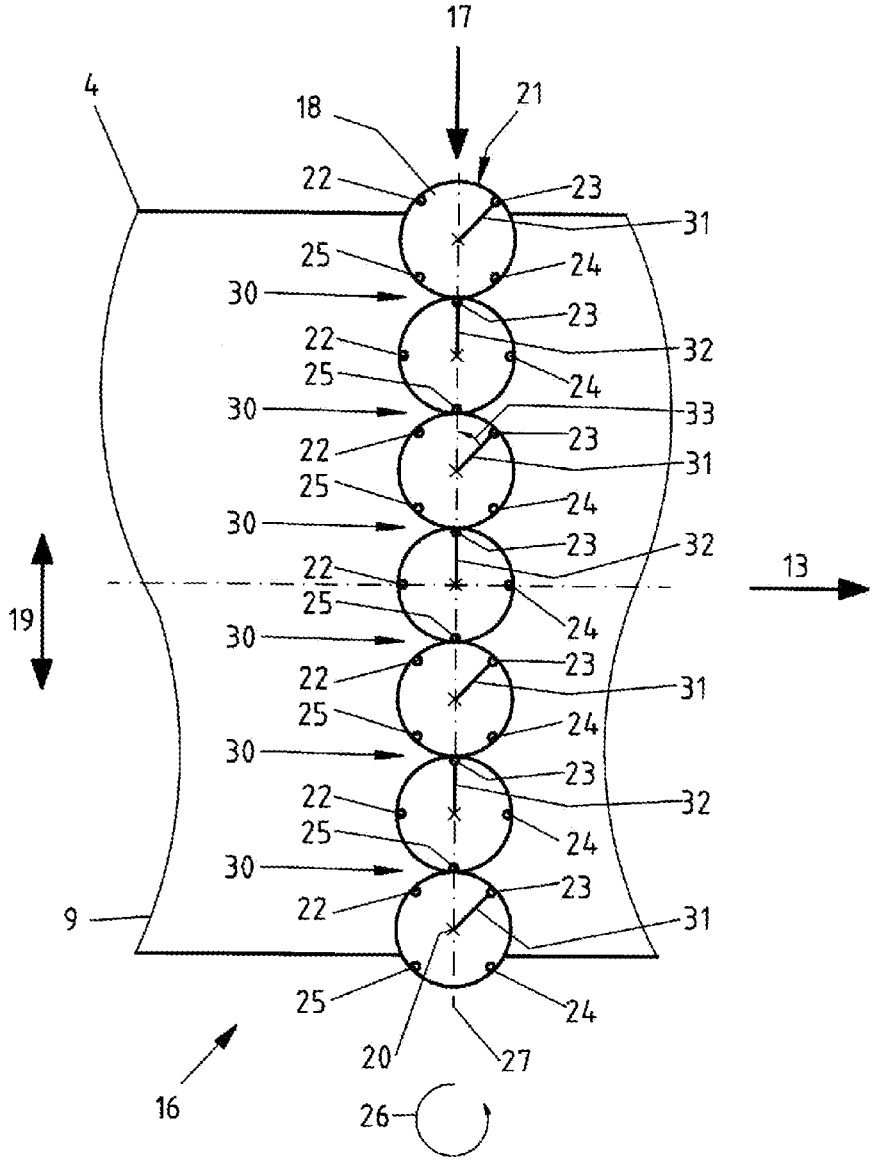
FIG. 2 schematically shows a plan view of a nozzle head part arrangement of a nozzle device of the descaling apparatus of the installation from FIG. 1.

This means that first ones of the nozzle head parts 18 are at a first angular position 31 with a rotation angle 33 (only designated by way of example) of 45° with regard to the fictitious connecting line 20, and further ones of the nozzle head parts 18, which are directly adjacent, are at a further angular position 32 with a further rotation angle (not indicated) of 0° with regard to the fictitious connecting line 20, as is shown by way of example with regard to the snapshot illustrated in FIG. 2.

For example, the nozzle elements 23 and 25, respectively, of some of the nozzle head parts 18 are congruent with the fictitious connecting line 20 (rotation angle=0°); they are thus temporarily positioned at the particular narrow point 30 of two immediately adjacent nozzle head parts 18, while the nozzle elements 24 and 25, and 22 and 23, respectively, of the nozzle head parts 18 directly adjacent thereto, are arranged in a manner rotated through 45° with respect to the narrow point 30 or from the fictitious connecting line 20.

As a result, it is possible to ensure in a particularly simple manner in terms of structure that the nozzle elements 22, 23, 24, 25 of two immediately adjacent nozzle head parts 18 are always guided past the narrow point 30 with a corresponding time lag.

Advantageously, the rotary movements of the individual nozzle head parts (18) and of their drive means (not shown here) are in this case preferably perpetually synchronized in a correct position, such that the individual nozzle head parts (18) always rotate in an oriented manner with respect to one another, as required.

It goes without saying that the exemplary embodiment explained here is merely a first configuration of the apparatus for descaling according to the invention. In this respect, the configuration of the invention is not limited to this exemplary embodiment.

LIST OF REFERENCE SIGNS

1 Apparatus for descaling
2 First metal surface
3 Second metal surface
4 Semifinished metal product
5 Installation for production
6 Casting machine
7 Mold
8 Casting bow
9 Metal strip
10 Roughing stands
11 Stands
12 Production line
13 Transporting direction
14 Induction furnace
15 Descaling device
16 Nozzle device
17 Row
18 Nozzle head parts
19 Widthwise direction
20 Rotation axis
21 Outer periphery
22 First nozzle element
23 Second nozzle element
24 Third nozzle element
25 Fourth nozzle element
26 Direction of rotation
27 Fictitious connecting line
30 Narrow points
31 First angular positions
32 Second angular positions
33 First rotation angle

The invention claimed is:

1. A method for descaling a metal surface of a semifinished metal product, comprising the steps of:

guiding the semifinished metal product in transporting direction past nozzle head parts that rotate about rotation axes and are arranged alongside one another transversely to the transporting direction;

directing high-pressure fluid jets produced by nozzle elements arranged on the rotating nozzle head parts at the metal surface, said fluid jets also being capable of being blasted as far as the metal surface at a narrow point between two immediately adjacent nozzle head parts; and rotating the nozzle head parts synchronously with one another at a preset angular position with respect to a rotation angle of a particular rotation axis of the nozzle head parts so that the nozzle elements of the two immediately adjacent nozzle head parts are never immediately adjacent and preventing the fluid jets produced by the nozzle elements of the two immediately adjacent nozzle head parts from overlapping so that the fluid jets are always blasted onto the metal surface past one another without coming into contact with one another at the narrow point.

2. The method as claimed in claim 1, wherein the nozzle head parts rotate at rotational speeds that are synchronized with one another.

3. The method as claimed in claim 1, including accelerating the nozzle head parts in a synchronized manner.

4. The method as claimed in claim 1, including calibrating the respective angular positions of the nozzle head parts with one another.

5. The method as claimed in claim 1, wherein the nozzle elements of two immediately adjacent nozzle head parts always pass the narrow point alternately so that the fluid jets produced by the nozzle elements are always blasted onto the metal surface past one another without coming into contact with one another.

6. The method as claimed in claim 1, wherein the nozzle elements of two immediately adjacent nozzle head parts are always guided past the narrow point with a time lag.

7. An apparatus for carrying out a method for descaling a metal surface of a semifinished metal product, comprising:

a nozzle device, past which the semifinished metal product is guidable in a transporting direction, wherein the nozzle device has a plurality of nozzle head parts that rotate about rotation axes, said nozzle head parts having nozzle elements that produce high-pressure fluid jets that are directed at the metal surface, wherein the nozzle head parts are arranged alongside one another so that the fluid jets produced by the nozzle elements are also blasted as far as the metal surface at a narrow point defined as a point between two immediately adjacent nozzle head parts, wherein the rotating nozzle head parts are each always arranged, in terms of angular position, oriented with respect to one another so the nozzle elements of the two immediately adjacent nozzle head parts are never immediately adjacent and so that the fluid jets produced by the nozzle elements of the two immediately adjacent nozzle head parts are prevented from overlapping so that the fluid jets are always blasted onto the metal surface past one another without coming into contact with one another at the narrow point; and wherein the nozzle head parts are connected together in a mechanically and/or electronically interacting manner so that the nozzle head parts of the nozzle device are each always arranged oriented at preset angular positions with respect to one another.

8. The apparatus as claimed in claim 7, wherein the nozzle elements of two immediately adjacent nozzle head parts are always arranged, in terms of their angular positions, oriented with respect to one another so that the fluid jets produced by the nozzle elements are always able to be blasted onto the metal surface past one another without coming into contact with one another.

9. The apparatus as claimed in claim 7, further comprising a drive device that drives the nozzle head parts in a synchronized manner in terms of rotational properties.

10. The apparatus as claimed in claim 7, wherein the nozzle elements of two immediately adjacent nozzle head parts are arranged, in terms of their angular position, offset by more than 5° with respect to one another.

11. The apparatus as claimed in claim 10, wherein the nozzle elements of two immediately adjacent nozzle head parts are arranged offset by more than 15° with respect to one another.

12. The apparatus as claimed in claim 11, wherein the nozzle elements of two immediately adjacent nozzle head parts are arranged offset by 45° with respect to one another.

13. An installation for producing semifinished metal products comprising an apparatus according to claim 7 for descaling metal surfaces of the semifinished metal products.

* * * * *